United States Patent [19]

Rogers

[11] 3,999,665

[45] Dec. 28, 1976

[54] METHOD AND APPARATUS FOR HANDLING A COIL

[75] Inventor: John W. Rogers, Shaker Heights, Ohio

[73] Assignee: Stamco Division, The Monarch Machine Tool Company, New Bremen, Ohio

[22] Filed: Mar. 5, 1975

[21] Appl. No.: 555,681

[52] U.S. Cl. ..... 214/1 BB; 214/130 C; 214/152; 214/DIG. 4; 212/81

[51] Int. Cl.[2] ..... B65H 19/02

[58] Field of Search ..... 214/1 BB, DIG. 4, 130 C, 214/152, 1 R; 242/81, 72.1

[56] References Cited

UNITED STATES PATENTS

| | | | |
|---|---|---|---|
| 2,586,376 | 2/1952 | Picton | 242/81 |
| 2,700,332 | 1/1955 | Donald | 214/130 C X |
| 3,598,251 | 8/1971 | Sicurin | 214/130 C X |

*Primary Examiner*—Robert J. Spar
*Assistant Examiner*—George F. Abraham
*Attorney, Agent, or Firm*—Biebel, French & Nauman

[57] ABSTRACT

The handling of metal coils, such as coils of sheet steel, aluminum or other materials is facilitated through the use of a transfer bar which is inserted in the coils before they are removed from a rewind mandrel. In a typical operation the transfer bar is inserted between the inside diameter of the coil and the outside diameter of the rewind mandrel adjacent the coil tail after the mandrel has been collapsed. The transfer bar is then raised into engagement with the coils, contacting them adjacent their tails, and the coils are thereafter carried by the transfer bar as they are moved from the rewind mandrel to a turnstile horn and from the turnstile horn to a downlayer. As a result, removal of the coil tails from the mandrel gripper slot is facilitated, eliminating telescoping of the coils upon removal from the mandrel, and damage to the inside diameters of the coils is obviated because there is no sliding of the coils along the mandrel or turnstile horn after they are carried by the transfer bar. Additionally, damage that often occurs to the coil edges is eliminated because separation between the coils is maintained as long as they are carried by the transfer bar and because separation is maintained, there is no interleaving of the edges of adjacent coils, thereby avoiding the problem of prying adjacent coils apart once they have become interleaved.

21 Claims, 12 Drawing Figures

METHOD AND APPARATUS FOR HANDLING A COIL

BACKGROUND OF THE INVENTION

In a typical coil processing operation coils of material such as sheet metal are placed upon an unwind stand, trained past a slitter and the slit coils then rewound on a rewind mandrel. Thereafter the rewind mandrel is collapsed and the slit, rewound coils are pushed off the rewind mandrel onto the horn of a turnstile, the turnstile horn having first been rotated into alignment with the rewind mandrel. The turnstile, now carrying the slit, rewound coils, is then rotated until its horn is aligned with the horn of a vertically oriented downlayer, and the coils pushed from the horn of the turnstile onto the horn of the downlayer. The downlayer is then pivoted to a horizontal position, its horn retracted, and the coils moved off the downlayer onto a conveyor.

Routine handling in the manner described above often results in damage to the coils in several different ways. For example, the tails or leading ends of the slit coil are held in a gripper slot in the rewind mandrel. It is quite common for these tails to become stuck in the gripper slot even after it has been opened, so that when an attempt is made to push the coils off the mandrel the coils tend to telescope and are damaged.

Furthermore, the mere act of sliding the coils from the madrel to the turnstile horn and from the turnstile horn to the downlayer horn will also often result in damage to the inside diameters of the coils.

Additionally, the edges of each wrap on each coil are quite often not aligned. Although adjacent coils are separated from each other on the rewind mandrel, it will be obvious that when an attempt is made to push the coils from one supporting member to another there is edge to edge contact between coils and the projecting edges may become bent over and damaged, thereby decreasing the efficiency of subsequent manufacturing operations using the damaged sheets, such as punch press operations.

It has also been found that, aside from outwardly projecting edges being bent in this manner it is quite common for such edges of adjacent coils to become interleaved. As a result, in later handling operations the coils must be pried apart from each other, markedly decreasing the speed and efficiency of the operation.

SUMMARY OF THE INVENTION

The present invention provides method and apparatus for handling coils which eliminates all of the problems outlined above. In essence, the present invention provides a transfer bar which is inserted between the inside diameters of the slit, rewound coils on the rewind mandrel and the outer diameter of the rewind mandrel at a point thereon adjacent the tails of the coils. Following insertion of the transfer bar it is raised into contact with the coils, engaging them adjacent their tails, and the coils are thereafter carried by the transfer bar through subsequent handling operations.

More specifically, after the rewind mandrel has been collapsed following a slitting-rewinding operation, the transfer bar is slid longitudinally into a slot extending longitudinally of the mandrel adjacent the gripper slot. The mandrel is then partially expanded, causing the transfer bar to raise into contact with the inside diameters of the coils, gripping the coils adjacent their tails or leading ends.

When the rewind pusher plate is thereafter activated, it engages the inner end of the transfer bar, pushing the transfer bar from the mandrel onto the aligned horn of the turnstile. As a result, there is no sliding movement of the coils along either the mandrel or the turnstile horn. Instead, the transfer bar slides along the mandrel and the transfer horn while the coils remain stationary relative to the bar and to each other, thereby avoiding damage to the inside diameters of the coils.

Additionally, because the transfer bar engages the coils adjacent the gripper slot, the tails of the coils are, in effect, pinched against the remainder of the coil, facilitating removal of the tails from the gripper slot and preventing telescoping of the coils and resultant damage. It will also be apparent that separation of the coils is maintained as they are transferred from one supporting member to another since there is no relative movement between them, and, therefore, damage to the coil edges and interleaving thereof is eliminated.

While in adapting the present invention to a conventional coil handling process the transfer bar will be pushed from the rewind mandrel to the turnstile horn by the pusher plate for the rewinder, it will be apparent that the pusher plate for the turnstile can be attached to the leading end of the transfer bar and the bar pulled from the rewind mandrel onto the turnstile horn.

In subsequent operations, particularly if the coil is to be handled in batch form, (that is, the group of coils rewound on a rewind mandrel handled as a group), the transfer bar, after the turnstile has pivoted to align the turnstile horn with the downlayer horn, is pushed off the turnstile horn by the turnstile pusher plate, with the separation between coils still maintained and damage to the inside diameter of the coils due to sliding along the turnstile horn, eliminated. Of course, if desired, the coils could be removed one at a time from the transfer bar on the turnstile horn to the horn of the downlayer.

It will also be apparent that, although the use of a transfer bar is described above and in the detailed description below in connection with the transfer of slit, rewound coils, a transfer bar could also be used to transfer coils from a turnstile feeding the unwind stand.

In any event, it will be seen that the present invention provides method and apparatus for improved coil handling, a consequent reduction in damage to the coils and more efficient processing.

DESCRIPTION OF THE PREFERRED EMBODIMENT

Figure 1:
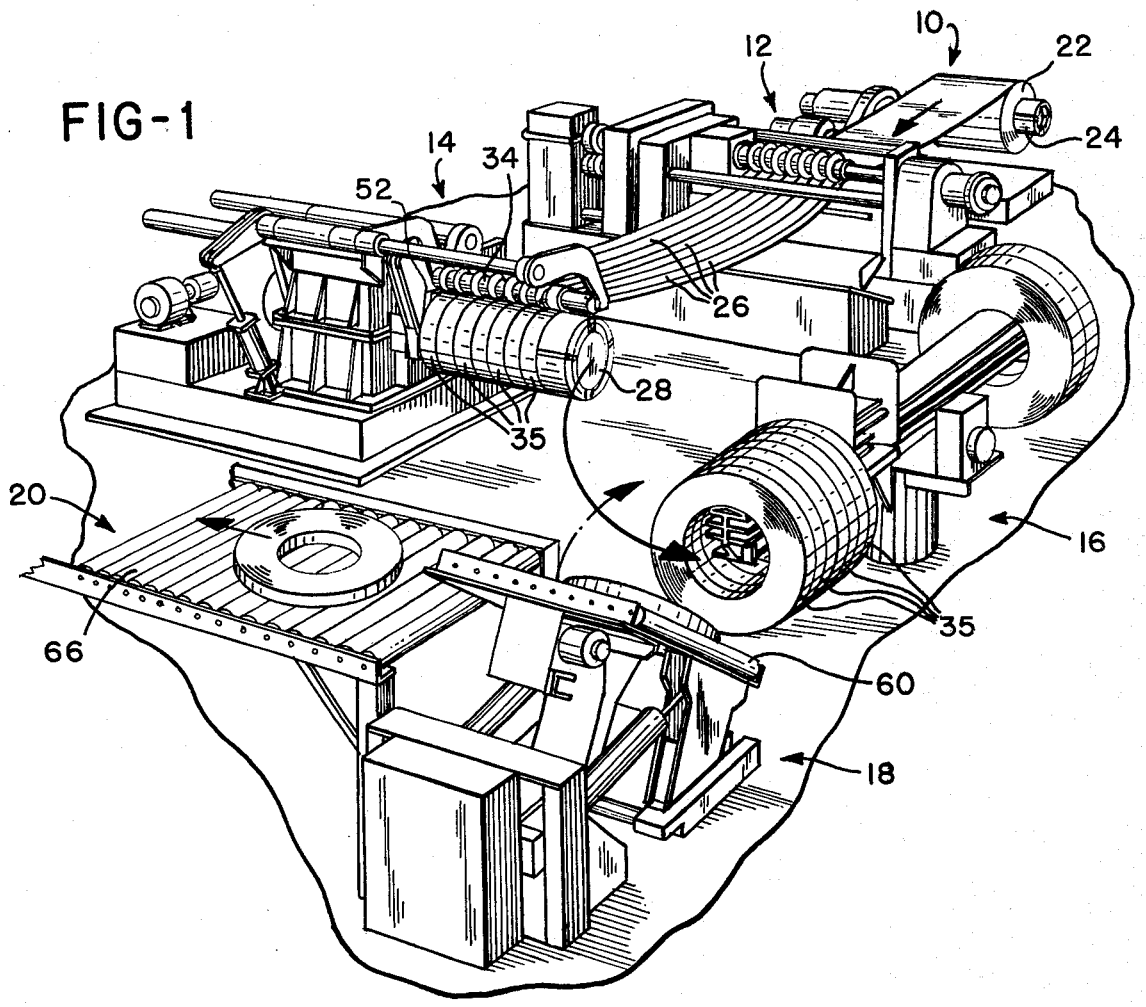
FIG. 1 is a perspective view of a typical coil handling operation.

As seen in FIG. 1 of the drawings, a typical processing line will include an unwinder 10, a slitter 12, a rewinder 14, a turnstile 16, a downlayer 18 and a conveyor 20. In operation, a coil 22 of sheet metal or the like is placed on an unwind mandrel 24 and threaded through the slitter 12 where the sheet is cut into a series of strips 26 of the desired width.

Figure 6A:
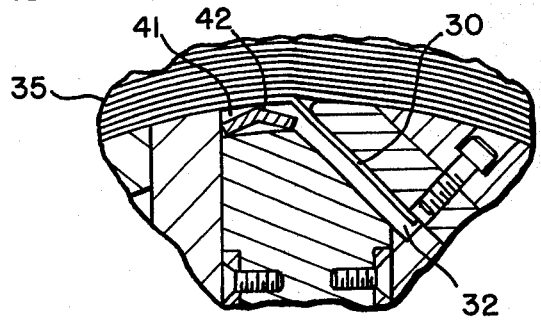
FIG. 6A is an enlarged view of a portion of FIG. 6.
Figure 5:
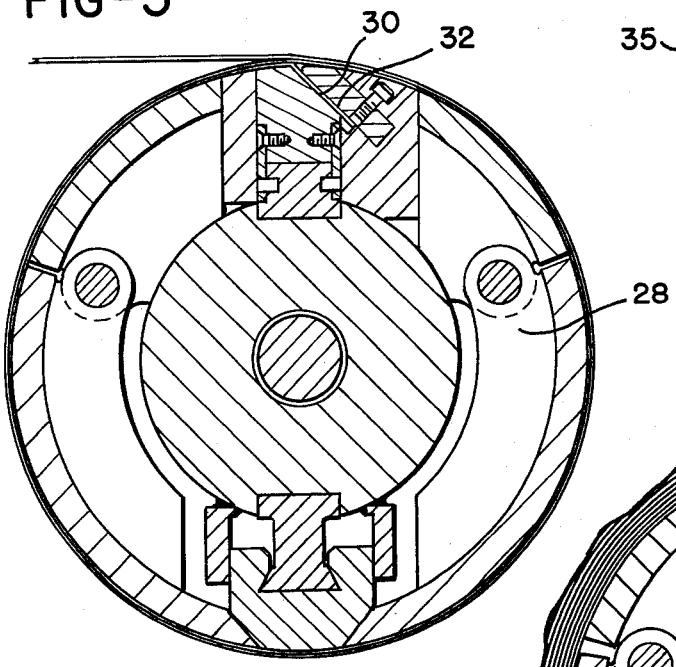
FIG. 5 is a cross-sectional view through a rewind mandrel showing a partially formed coil thereon.
Figure 6:
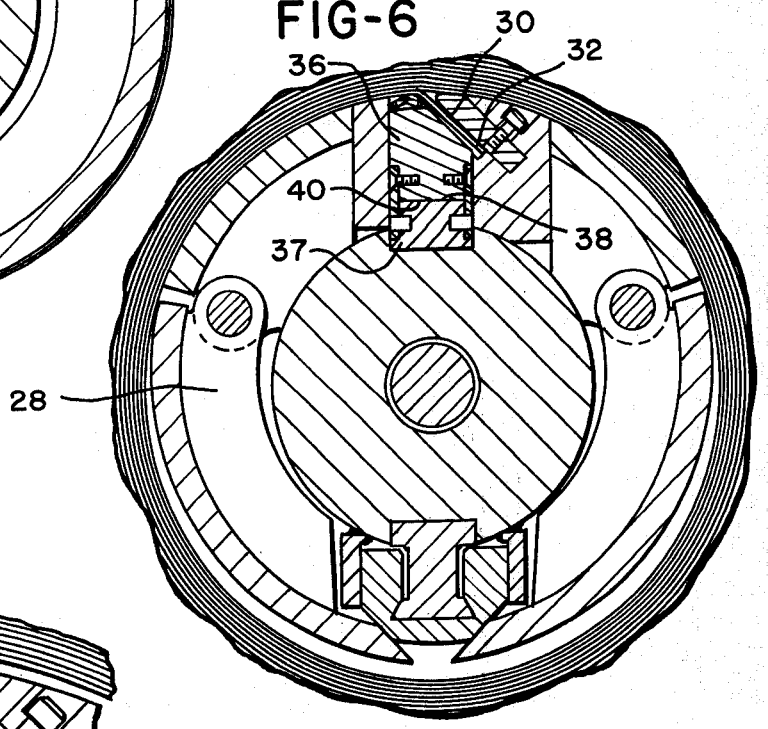
FIG. 6 is a cross-sectional view through a rewind mandrel in its collapsed position, showing a portion of a coil wound thereon.

The strips 26 are then wound on a rewind mandrel 28 with their tails or leading edges 30 (FIG. 5) clamped in a gripper slot 32 of the mandrel 28. During the rewinding operation an overarm separator 34 (FIG. 1) maintains a spacing between adjacent coils 35. Upon completion of the rewinding operation the mandrel 28 is collapsed, assuming the configuration shown in FIGS. 6 and 6A of the drawings.

In a typical mandrel of this type, relaxation of the mandrel is accompanied by an opening of the gripper slot 32. This in turn is accomplished by relative longitudinal movement between two bars 36 and 37, in engagement with each other along inclined surfaces 38 and 40, respectively. As a result, upon relative longitudinal movement between the bars 36 and 37, the bar 36 moves radially inwardly, defining a slot 41. The above description of the operation of typical gripper slot components is well known to those skilled in the art and a further description thereof is considered unnecessary for purposes of the present application.

Figure 3:
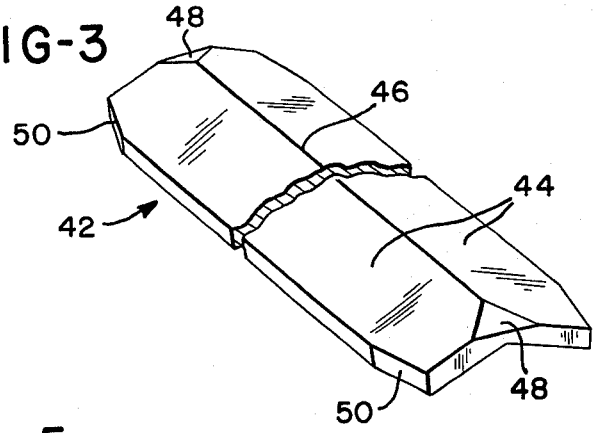
FIG. 3 is a perspective view of a transfer bar in accordance with the present invention.
Figure 4:
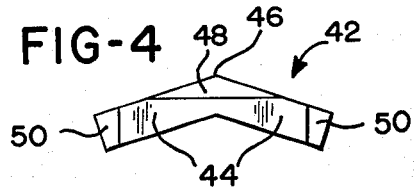
FIG. 4 is an end view of the bar of FIG. 3.
Figure 7:
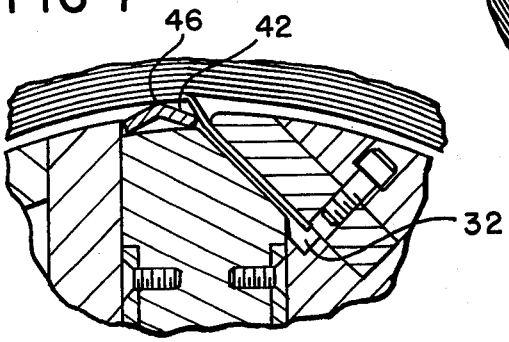
FIG. 7 is an enlarged view similar to FIG. 6A but showing the mandrel expanded.

Following collapsing of the mandrel 28, a transfer bar 42, which is shown per se in FIGS. 3 and 4 of the drawings, is inserted into the slot 41 between the inside diameters of the coils 35 and the outside diameter of the mandrel 28. The mandrel is then partially expanded from the configuration shown in FIG. 6A of the drawings to that shown in FIG. 7, lifting the relatively rigid coils from the upper surface of the mandrel with the coils thereafter being carried by the transfer bar 42.

Although the transfer bar may be simply a length of rod or bar stock, in practice the bar shown in FIGS. 3 and 4 of the drawings has proven satisfactory. As seen in FIGS. 3 and 4, the transfer bar includes a pair of related legs 44 which meet at an apex 46. Additionally, each end of the bar 42 is bevelled, as at 48 and 50. Bevelling of the ends of the bar facilitates insertion thereof into the coil, while the angular configuration of the transfer bar legs results in the leading ends or tails of the coils being pinched against the remainder of the coil by the apex 46 of the bar. A positive gripping force is, therefore, exerted on the coil adjacent the gripper slot 32, preventing the tails of the coils from becoming hung up in the gripper slot while they are being removed from the mandrel.

Figure 2:
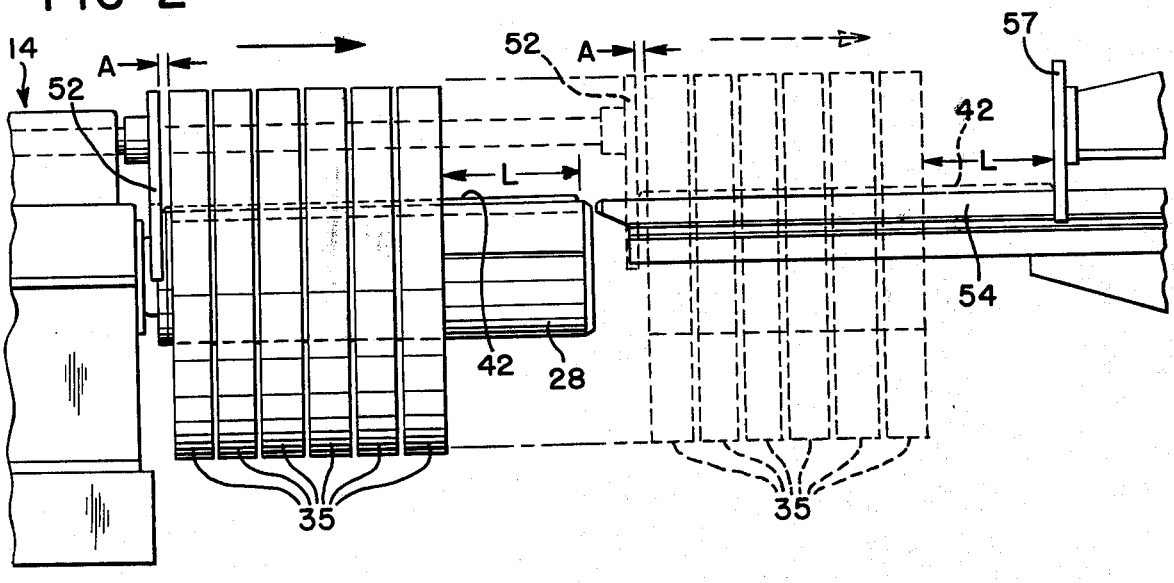
FIG. 2 is an elevational view illustrating the transfer of coil from a rewind mandrel to a turnstile horn.
Figure 9:
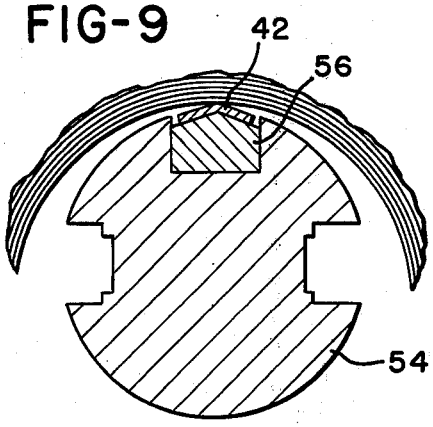
FIG. 9 is a view taken on line 9—9 of FIG. 8.

In this regard, it will be noted from FIG. 2 of the drawings, that the coils 35 carried by the transfer bar 42 are removed from the mandrel 28 by engagement of a hydraulically actuated pusher plate 52 with the inner or trailing end of the transfer bar. Outward movement of the pusher plate from the solid to the dotted line position shown in FIG. 2 of the drawings will result in transfer bar 42 and the coils carried thereby shifting from the solid to the dotted line position shown in FIG. 2 of the drawings. Preferably, the horn 54 of the turnstile 16 may be provided, as best seen in FIG. 9 of the drawings, with an insert 56 serving as a track member to receive slidably the transfer bar 42. Additionally, the turnstile will be provided with a pusher plate 57.

Figure 11:
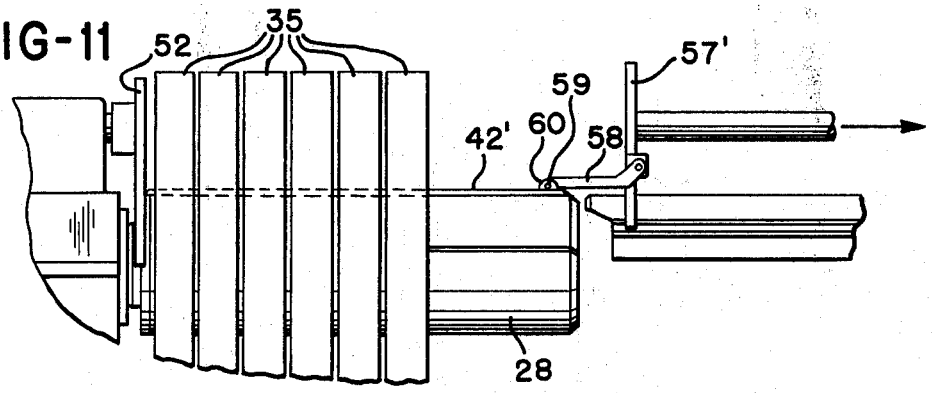
FIG. 11 is a view similar to FIG. 2, but showing a modified form of the invention.

As noted above, instead of pushing the transfer bar and coils from the mandrel to the turnstile horn, the turnstile may be provided with a modified pusher plate 57' having a pivoted arm 58, as seen in FIG. 11. The end of arm 58 may have an opening therethrough adapted to receive a pin 59 to attach the arm to a clevis-like fixture 60 mounted on the transfer bar 42'. Thus, the transfer bar 42' and the coils 35 can be pulled off the mandrel 28, as indicated by the arrow in FIG. 11 of the drawings.

Figure 8:
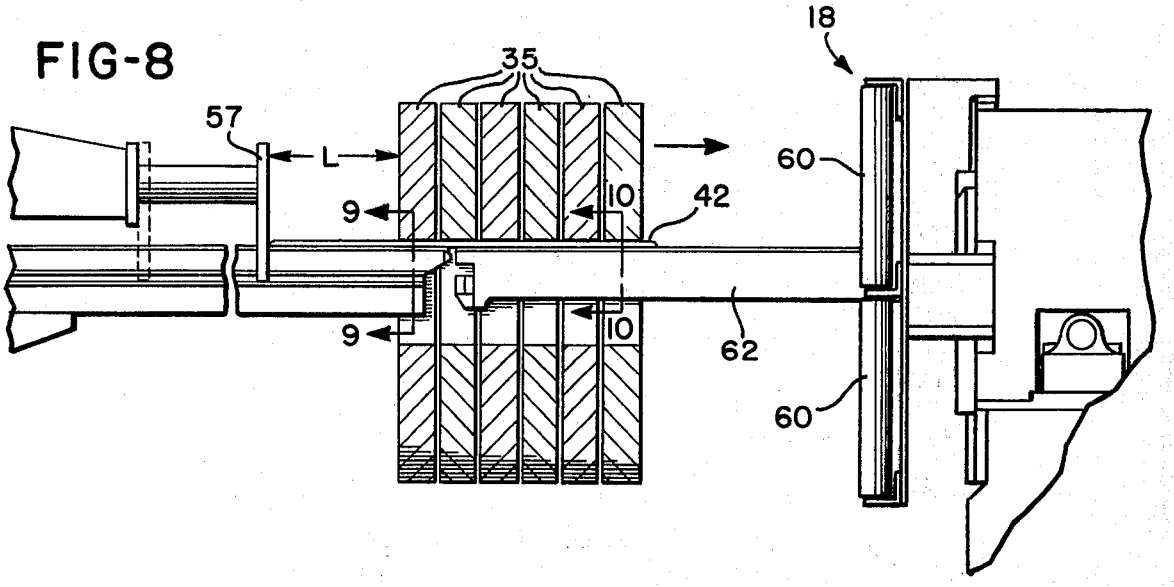
FIG. 8 is an elevational view but showing the transfer of coils from the turnstile horn to the downlayer horn.

Regardless of whether the transfer bar is pushed or pulled onto the turnstile horn, after the bar and coils are on the turnstile horn the turnstile is pivoted from the position shown in FIGS. 2 and 11 of the drawings to the position shown in FIGS. 1 and 8 of the drawings. In this position, and with the downlayer 18 having its coil receiving face defined by rollers 61 disposed vertically as seen in FIG. 8 of the drawings and its horn 62 extended, the transfer bar 42 or 42' and the coils 35 are then moved onto the horn 62 of the downlayer 18.

Figure 10:
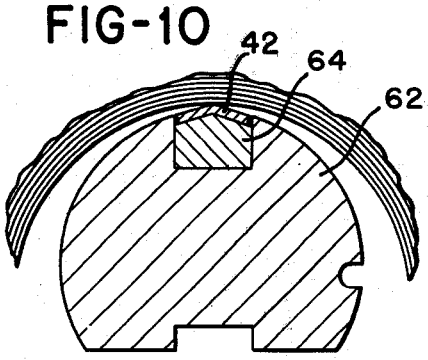
FIG. 10 is a view taken on line 10—10 of FIG. 8.

As seen in FIG. 10 of the drawings, the horn 62 of the downlayer may, similarly to the horn 54 of the turnstile, be provided with an insert 64 forming a track for slidably receiving the transfer bar 42 or 42'. Again, during this sliding operation there is no sliding movement between the coils and transfer bar. Coil separation is therefore maintained, preventing damage to coil edges and interleaving thereof and avoiding sliding damage to the inside diameters of the coils.

Once the coils have been received on the horn 62 of the downlayer the downlayer is turned to a position such that a bed of rollers 61 is aligned with the roller bed 66 of the conveyor 20, the horn 62 of the downlayer retracted and the coils conveyed away for further processing. After retraction of the downlayer horn 62, the transfer bar 42 is, or course, removed.

In the above operation, the coils 35 are removed in a group or batch from the turnstile to the downlayer. While this is suitable with coils intended for some end product uses, it will be apparent that with others it may be desirable to transfer the coils from the turnstile to the downlayer one at a time.

Regardless of whether the coils are treated on a batch basis or individually at the downlayer, it will be seen that the present invention provides method and apparatus for handling coils during normal processing operations in a manner which obviates many problems of conventional coil operations and provides a superior product relatively free of damage.

While the methods and form of apparatus herein described constitute preferred embodiments of the invention, it is to be understood that the invention is not limited to these precise methods and this precise form of apparatus, and that changes may be made therein without departing from the scope of the invention.

What is claimed is:

1. Coil handling apparatus comprising:

a. an elongated coil supporting member adapted to be received internally within a coil of material, b. a transfer member received on and extending longitudinally of said supporting member intermediate an outer surface of said supporting member and an inner surface of a coil of material supported thereby, c. said transfer member being capable of movement with respect to said supporting member in a direction generally perpendicular to the longitudinal axis of said supporting member to lift coil from contact with said supporting member whereby the coil is carried by said transfer member, and d. means for moving said transfer member longitudinally of said supporting member with the coil carried by said transfer member for removing the coil from said supporting member.

2. The apparatus of claim 1 further comprising:

a. a slot formed in said outer surface of said supporting member, extending longitudinally thereof and receiving said transfer member therein.

3. The apparatus of claim 1 wherein:

a. said transfer member is separate from and unattached to said supporting member.

4. The apparatus of claim 3 further comprising:

a. a slot formed in said outer surface of said supporting member, extending longitudinally thereof and receiving said transfer member therein.

5. The apparatus of claim 1 wherein:

a. said transfer member is in slidable contact with said supporting member.

6. The apparatus of claim 1 wherein:

a. said supporting member is a mandrel.

7. The apparatus of claim 1 wherein:

a. said supporting member is a turnstile horn.

8. The apparatus of claim 1 wherein:

a. said means for moving said transfer member longitudinally of said supporting member is a pusher plate mounted for movement longitudinally of said supporting member and engageable with an end of said transfer member.

9. The apparatus of claim 8 further comprising:

a. means for attaching said pusher plate to said transfer member to permit said pusher plate to pull said transfer member.

10. The apparatus of claim 1 wherein:

a. said transfer member is an elongated bar.

11. The apparatus of claim 10 wherein:

a. said bar comprises a pair of longitudinally extending angularly related legs.

12. The apparatus of claim 10 wherein:

a. said bar is provided with bevelled ends.

13. A method of removing coil from a supporting member received within a coil and supporting it by contact between an outer surface of said supporting member and an inner surface of the coil comprising:

a. inserting an elongated bar between said outer surface of said member and said inner surface of coil carried by said member, b. transferring support of said coil from said member to said bar by raising said bar upwardly with respect to said member above said outer surface thereof and into contact with said inner surface of said coil, and c. moving said bar with said coil carried thereby, longitudinally of said member until said coil is clear of said member.

14. The method of claim 13 wherein said supporting member is a mandrel and said step of inserting said bar comprises:

a. inserting said bar between an upper surface of the mandrel and an inner surface of coil carried by said mandrel.

15. The method of claim 14 further comprising:

a. rotating said mandrel prior to inserting said bar until said coil is positioned such that when said bar is raised upwardly, said bar engages said inner surface of said coil adjacent the leading end thereof.

16. The method of claim 14 further comprising:

a. collapsing said mandrel prior to inserting said bar.

17. The method of claim 16 further comprising:

a. partially expanding said mandrel following insertion of said bar to cause said raising thereof.

18. The method of claim 15 wherein said moving of said bar longitudinally of said mandrel comprises:

a. engaging an end of said bar and pushing said bar longitudinally of said mandrel.

19. The method of claim 15 wherein said moving of said bar longitudinally of said mandrel comprises:

a. engaging an end of said bar and pulling said bar longitudinally of said mandrel.

20. The method of claim 15 wherein said step of inserting said bar comprises:

a. sliding said bar into a slot defined in the periphery of said mandrel when said mandrel is in an unexpanded condition.

21. Coil handling apparatus comprising:

an elongated coil supporting member adapted to be received within a coil of material with an outer surface of said supporting member in contact with an inner surface of a coil of material surrounding said supporting member, an elongated slot formed in said outer surface of said supporting member and extending longitudinally thereof, an elongated bar including a pair of longitudinally extending, angularly related legs, said bar being received within said slot in slidable contact with said supporting member, said bar being capable of movement with respect to said supporting member in a direction generally perpendicular to the longitudinal axis of said supporting member to lift coils surrounding said supporting member from contact therewith whereby the coil surrounding said supporting member is carried by said bar, and means for moving said bar longitudinally of said supporting member with a coil carried by said bar.

* * * * *